US011134354B1

(12) United States Patent
Lesso

(10) Patent No.: US 11,134,354 B1
(45) Date of Patent: Sep. 28, 2021

(54) WEAR DETECTION

(71) Applicant: Cirrus Logic International Semiconductor Ltd., Edinburgh (GB)

(72) Inventor: John P. Lesso, Edinburgh (GB)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 16/901,073

(22) Filed: Jun. 15, 2020

(51) Int. Cl.

| | |
|---|---|
| ***H04R 29/00*** | (2006.01) |
| ***H04R 1/10*** | (2006.01) |
| ***G10L 25/06*** | (2013.01) |
| ***G10L 25/93*** | (2013.01) |

(52) U.S. Cl.
CPC ..... *H04R 29/004* (2013.01); *G10L 25/06* (2013.01); *G10L 25/93* (2013.01); *H04R 1/10* (2013.01)

(58) Field of Classification Search
CPC ..... H04R 29/004; H04R 1/10; G10L 25/06; G10L 25/93
See application file for complete search history.

(56) References Cited

U.S. PATENT DOCUMENTS

| | | | | |
|---|---|---|---|---|
| 8,243,946 | B2 * | 8/2012 | Burge | H04R 1/1041 381/74 |
| 8,891,779 | B2 * | 11/2014 | Michaelis | H04R 1/1016 381/58 |
| 9,883,278 | B1 * | 1/2018 | Lin | H04R 5/033 |
| 9,924,270 | B2 * | 3/2018 | Shanmugam | H04R 5/033 |
| 10,535,364 | B1 * | 1/2020 | Zhong | H04R 1/02 |
| 2015/0256953 | A1 * | 9/2015 | Kwatra | H04R 1/1083 381/58 |
| 2016/0037278 | A1 * | 2/2016 | Voix | H04R 29/004 381/58 |
| 2018/0132048 | A1 * | 5/2018 | Usher | H04R 29/00 |
| 2018/0152795 | A1 | 5/2018 | Lee et al. | |
| 2021/0186350 | A1 * | 6/2021 | Lesso | A61B 5/4803 |

FOREIGN PATENT DOCUMENTS

| | | |
|---|---|---|
| CN | 105228041 B | 8/2019 |
| CN | 110121129 A | 8/2019 |

OTHER PUBLICATIONS

International Search Report and Written Opinion of the International Searching Authority, International Application No. PCT/GB2021/051171, dated Jul. 29, 2021.

* cited by examiner

*Primary Examiner* — David L Ton
(74) *Attorney, Agent, or Firm* — Jackson Walker L.L.P.

(57) ABSTRACT

A method is used of detecting whether a device is being worn, when the device comprises a first transducer and a second transducer. It is determined when a signal detected by at least one of the first and second transducers represents speech. It is then determined when said speech contains speech of a first acoustic class and speech of a second acoustic class. A first correlation signal is generated, representing a correlation between signals generated by the first and second transducers during at least one period when said speech contains speech of the first acoustic class. A second correlation signal is generated, representing a correlation between signals generated by the first and second transducers during at least one period when said speech contains speech of the second acoustic class. It is then determined from the first correlation signal and the second correlation signal whether the device is being worn.

20 Claims, 11 Drawing Sheets

WEAR DETECTION

TECHNICAL FIELD

Embodiments described herein relate to methods and devices for detecting whether a device is being worn.

BACKGROUND

Many electronic devices are wearable, or have wearable accessories.

For ease of use, it is convenient for a person wearing the device or accessory simply to remove it, without needing to switch it off, but this can result in unnecessary battery usage if the device or accessory continues to use power while it is not being worn.

It is therefore advantageous to be able to detect whether a device is being worn.

SUMMARY

According to a first aspect of the invention, there is provided a method of detecting whether a device is being worn, wherein the device comprises a first transducer and a second transducer. The method comprises determining when a signal detected by at least one of the first and second transducers represents speech; and determining when said speech contains speech of a first acoustic class and speech of a second acoustic class. The method then comprises: generating a first correlation signal, wherein the first correlation signal represents a correlation between signals generated by the first and second transducers during at least one period when said speech contains speech of the first acoustic class; and generating a second correlation signal, wherein the second correlation signal represents a correlation between signals generated by the first and second transducers during at least one period when said speech contains speech of the second acoustic class. The method finally comprises determining from the first correlation signal and the second correlation signal whether the device is being worn.

Generating the first correlation signal may comprise:

calculating energies of the signals generated by the first and second transducers during at least one period when said speech contains speech of the first acoustic class; and calculating a correlation between said signals generated by the first and second transducers during said at least one period when said speech contains speech of the first acoustic class.

Generating the second correlation signal may comprise:

calculating energies of the signals generated by the first and second transducers during at least one period when said speech contains speech of the second acoustic class; and calculating a correlation between said signals generated by the first and second transducers during said at least one period when said speech contains speech of the second acoustic class.

The first acoustic class may comprise voiced speech, and/or the second acoustic class may comprise unvoiced speech.

The device may be configured such that, when the device is being worn, the first transducer is able to detect ambient sounds transmitted through the air, and the second transducer is able to detect signals transmitted through the head of a wearer. In that case, the method may comprise determining that the device is being worn if the first correlation signal exceeds a first threshold value and the second correlation signal is lower than a second threshold value, and otherwise determining that the device is not being worn.

The first transducer may comprise a microphone.

The second transducer may comprise a microphone. In other embodiments, the second transducer may comprise an accelerometer.

According to a second aspect, there is provided a device comprising: a processor configured for receiving signals from a first transducer and a second transducer, and further configured for performing a method comprising: determining when a signal detected by at least one of the first and second transducers represents speech; determining when said speech contains speech of a first acoustic class and speech of a second acoustic class; generating a first correlation signal, wherein the first correlation signal represents a correlation between signals generated by the first and second transducers during at least one period when said speech contains speech of the first acoustic class; generating a second correlation signal, wherein the second correlation signal represents a correlation between signals generated by the first and second transducers during at least one period when said speech contains speech of the second acoustic class; and determining from the first correlation signal and the second correlation signal whether the device is being worn.

The device may further comprise the first and second transducers, with the first transducer being positioned such that it can detect a sound of a wearer's speech, and the second transducer being positioned such that, when the device is being worn, the second transducer can generate a signal in response to transmission of the wearer's speech through the wearer's body.

The first transducer may comprise a microphone.

The second transducer may comprise an accelerometer. Alternatively, the second transducer may comprise a microphone.

The device may comprise a headset, with the second transducer being positioned such that, when the device is being worn, the second transducer is located in an ear canal of the wearer.

The device may then be configured for determining that the device is being worn if the first correlation signal exceeds a first threshold value and the second correlation signal is lower than a second threshold value, and otherwise determining that the device is not being worn.

The second transducer may be positioned on the device such that, when the device is being worn, the second transducer is located on a bridge of the nose of the wearer.

The device may then be configured for determining that the device is being worn if the first correlation signal exceeds a first threshold value and the second correlation signal is lower than a second threshold value, and otherwise determining that the device is not being worn.

For example, such a device may comprise smart glasses, a virtual reality headset, or an augmented reality headset.

Alternatively, the device may further comprise an input for receiving said signals from the first and second transducers from a separate device.

According to a third aspect of the invention, there is provided a computer program product, comprising machine readable code containing instructions for causing an audio processing circuit to perform a method according to the first aspect.

BRIEF DESCRIPTION OF DRAWINGS

For a better understanding of the present invention, and to show how it may be put into effect, reference will now be made to the accompanying drawings, in which.

DETAILED DESCRIPTION OF EMBODIMENTS

The description below sets forth example embodiments according to this disclosure. Further example embodiments and implementations will be apparent to those having ordinary skill in the art. Further, those having ordinary skill in the art will recognize that various equivalent techniques may be applied in lieu of, or in conjunction with, the embodiments discussed below, and all such equivalents should be deemed as being encompassed by the present disclosure.

The methods described herein may be implemented in a wide range of devices and systems. However, for ease of explanation of one embodiment, an illustrative example will be described, in which the implementation occurs in a host device, which is used with a wearable accessory. A further illustrative example will then be described, in which the implementation occurs in a wearable device.

Figure 1:
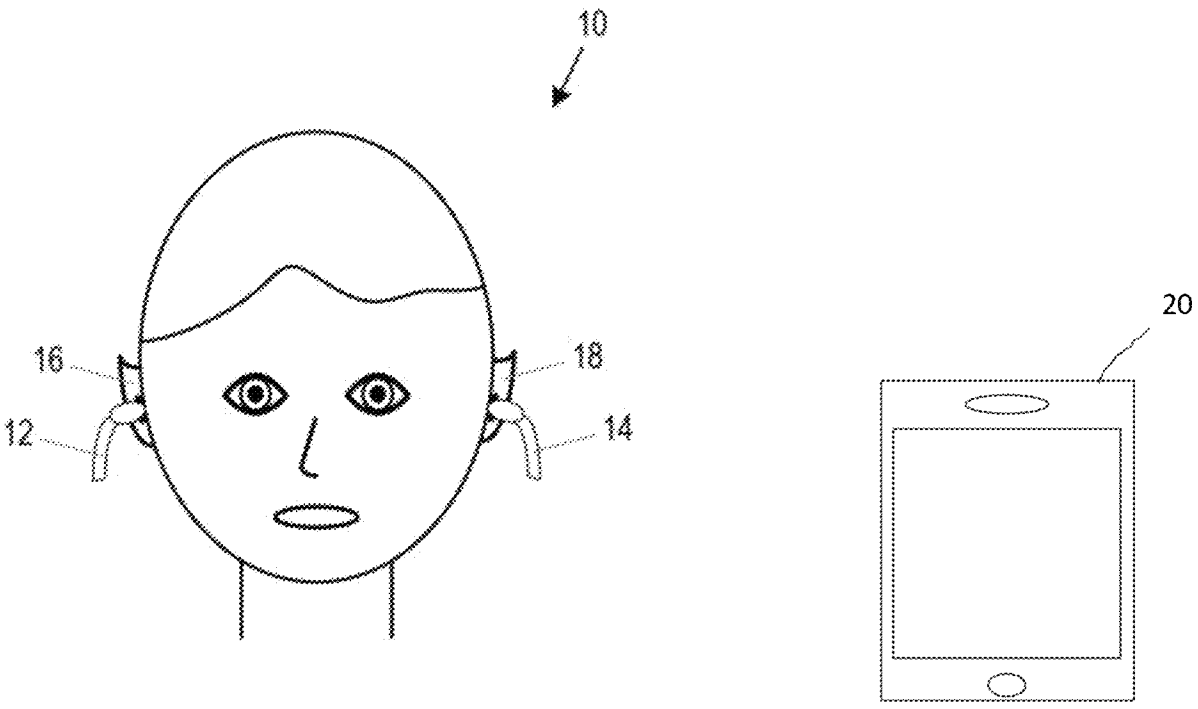
FIG. 1 illustrates an example of a device being worn by a user.

FIG. 1 illustrates an example of a device being worn by a user.

Specifically, FIG. 1 illustrates a person wearing an earphone. More specifically, FIG. 1 shows a person 10, wearing one wireless earbud 12, 14 in each ear 16, 18. Although this shows a person wearing two earbuds, the method is applicable when only one earbud is being worn.

In addition, although FIG. 1 shows a person wearing wireless earbuds, the method is applicable to any wired or wireless earbuds or earphones, for example in-ear earphones, supra-aural earphones, or supra-concha earphones.

In this example, a host device 20, which may for example be a handheld device such as a smartphone, acts as a source of signals to be played through the earbuds 12, 14.

The method is applicable to any wearable device that can be used with a host device.

Figure 2:
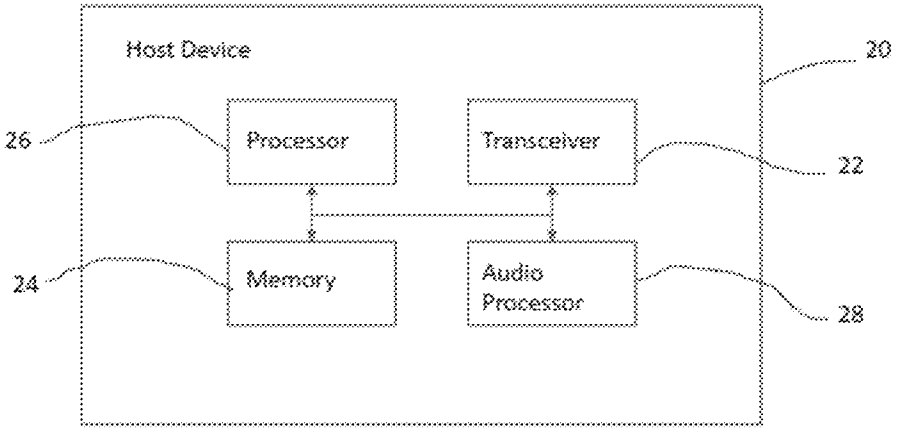
FIG. 2 is a schematic diagram, illustrating the form of a host device.

FIG. 2 is a schematic diagram, illustrating the form of a host device 20.

The host device 20 may for example take the form of a smartphone, a laptop or tablet computer, a smart speaker, a games console, a home control system, a home entertainment system, an in-vehicle entertainment system, a domestic appliance, or any other suitable device.

Specifically, FIG. 2 shows various interconnected components of the host device 20. It will be appreciated that the host device 20 will in practice contain many other components, but the following description is sufficient for an understanding of embodiments of the present disclosure.

Thus, FIG. 2 shows a transceiver 22, which is provided for allowing the host device 20 to communicate with other devices. Specifically, the transceiver 22 may include circuitry for communicating over a short-range wireless link with an accessory, such as the accessory shown in FIG. 1. In addition, the transceiver 22 may include circuitry for establishing an internet connection either over a WiFi local area network or over a cellular network.

FIG. 2 also shows a memory 24, which may in practice be provided as a single component or as multiple components. The memory 24 is provided for storing data and program instructions.

FIG. 2 also shows a processor 26, which again may in practice be provided as a single component or as multiple components. For example, one component of the processor 26 may be an applications processor when the host device 20 is a smartphone.

FIG. 2 also shows audio processing circuitry 28, for performing operations on received audio signals as required. For example, the audio processing circuitry 28 may filter the audio signals or perform other signal processing operations.

In addition, the audio processing circuitry 28 may act as a source of music and/or speech signals that can be transmitted to the accessory for playback through loudspeakers in the earbuds 12, 14.

The host device 20 may be provided with voice biometric functionality, and with control functionality. In this case, the device 20 is able to perform various functions in response to spoken commands from an enrolled user. The biometric functionality is able to distinguish between spoken commands from the enrolled user, and the same commands when spoken by a different person. Thus, certain embodiments of the present disclosure relate to operation of a smartphone or another portable electronic host device with some sort of voice operability, in which the voice biometric functionality is performed in the host device that is intended to carry out the spoken command. Certain other embodiments relate to systems in which the voice biometric functionality is performed on a smartphone or other host device, which then transmits the commands to a separate device if the voice biometric functionality is able to confirm that the speaker was the enrolled user.

Figure 3:
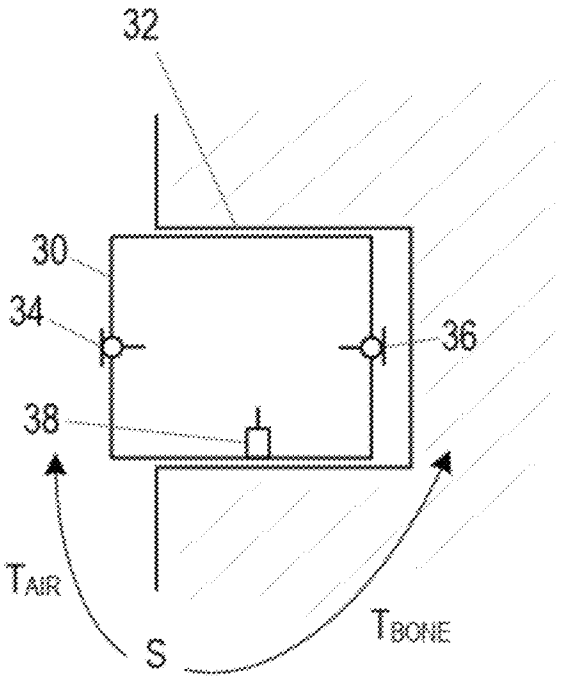
FIG. 3 illustrates in more detail a part of the device of FIG. 1.

FIG. 3 illustrates in more detail a part of the device of FIG. 1.

Specifically, FIG. 3 illustrates an example where the accessory device is an earphone, which is being worn. More specifically, FIG. 3 shows an earbud 30 at the entrance to a wearer's ear canal 32.

In general terms, the earphone comprises a first transducer and a second transducer. While a person is wearing the earphone, a first transducer is located on an outward facing part of the earphone and a second transducer is located on a part of the earphone facing into the person's ear canal.

In the embodiment shown in FIG. 3, the first transducer comprises a microphone 34, located such that it can detect ambient sound in the vicinity of the earbud 30.

In the embodiment shown in FIG. 3, the earbud 30 also comprises a second microphone 36, located such that it can detect sound in the wearer's ear canal 32. The earbud 30 also comprises an accelerometer 38, located on the earbud 30 such that it can detect vibrations in the surface of the wearer's ear canal 32 resulting from the transmission of sound through the wearer's head. The second transducer, mentioned above, can be the second microphone 36, or can be the accelerometer 38.

As mentioned above, the accessory device may be any suitable wearable device, which is provided with a microphone for detecting sound that has travelled through the air, and is also provided with a second transducer such as an accelerometer that is mounted in a position that is in contact with the wearer's head when the accessory is being worn, such that the accelerometer can detect vibrations resulting from the transmission of sound through the wearer's head.

In particular, embodiments described herein obtain information about the sound conduction path, through the wearer's head, by comparing the signals detected by the first transducer and the second transducer. More specifically, embodiments described herein obtain information about the sound conduction path, through the wearer's head, by comparing the signals detected by the first transducer and the second transducer at times when the wearer is speaking.

Thus, as shown in FIG. 3, when the wearer is speaking and generating a sound S, this is modified by a first transfer function $T_{AIR}$ through the air before it is detected by the external microphone 34, and it is modified by a second transfer function $T_{BONE}$ through the bone and soft tissue of the wearer's head before it is detected by the internal transducer 36 or 38.

The processing of the signals generated by the external microphone 34, and by the one or more internal transducer 36, 38, may be performed in circuitry provided within the earbud 30 itself. However, in embodiments described herein, the signals generated by the external microphone 34 and by the one or more internal transducer 36, 38 may be transmitted by a suitable wired or wireless connection to the host device 20, where the processing of the signals, as described in more detail below, takes place.

Figure 4:
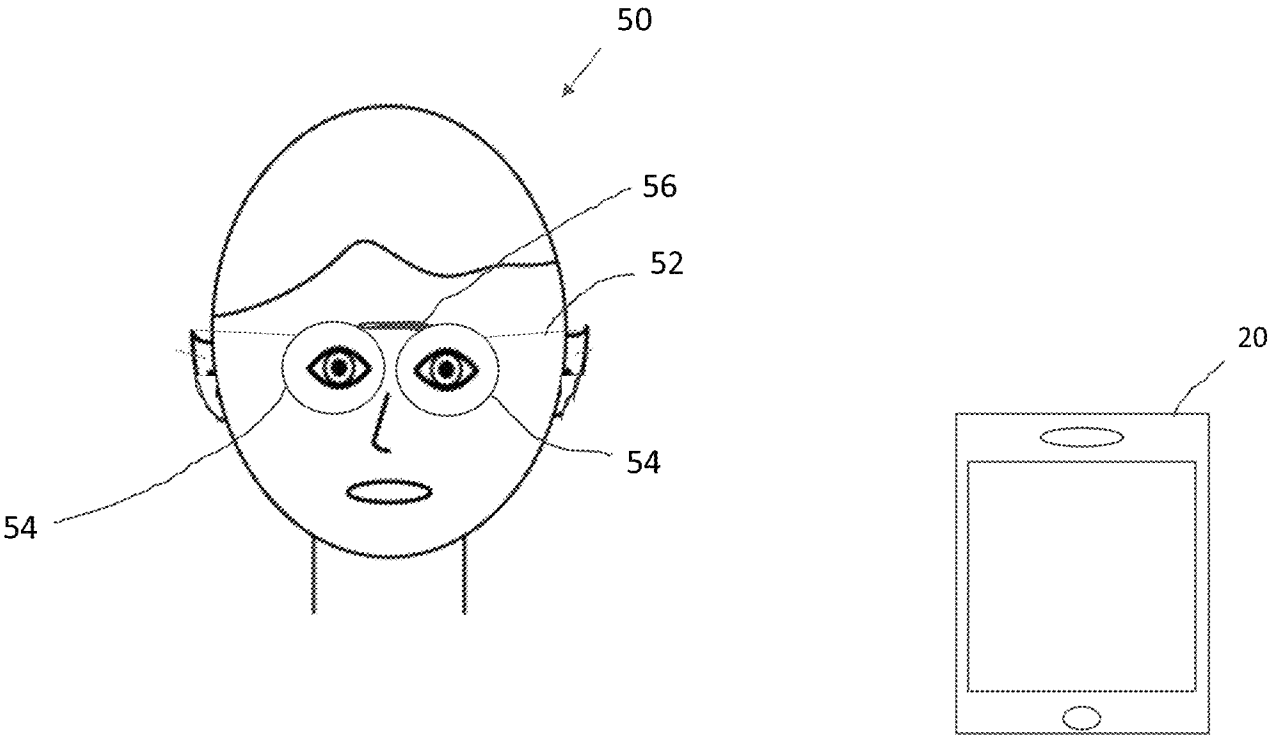
FIG. 4 illustrates a second example of a device being worn by a user.

FIG. 4 illustrates a second example of a device being worn by a user.

Specifically, FIG. 4 illustrates a person wearing a pair of smart glasses. More specifically, FIG. 1 shows a person 50, wearing a pair of smart glasses 52. The smart glasses 52 have a pair of eyepieces 54, connected by a central portion 56 that passes over the bridge of the wearer's nose.

FIG. 4 shows a person a pair of smart glasses 52, but the method is applicable to any wearable device such as a virtual reality or augmented reality headset, or a wearable camera.

FIG. 4 also shows a host device 20, which may for example be a handheld device such as a smartphone, which has a connected to the smart glasses 52. Thus, the smart glasses 52 may be used with the host device, as described with reference to FIGS. 1, 2 and 3.

In other embodiments, the wearable device, such as the smart glasses 52, need not be used with a host device.

Figure 5:
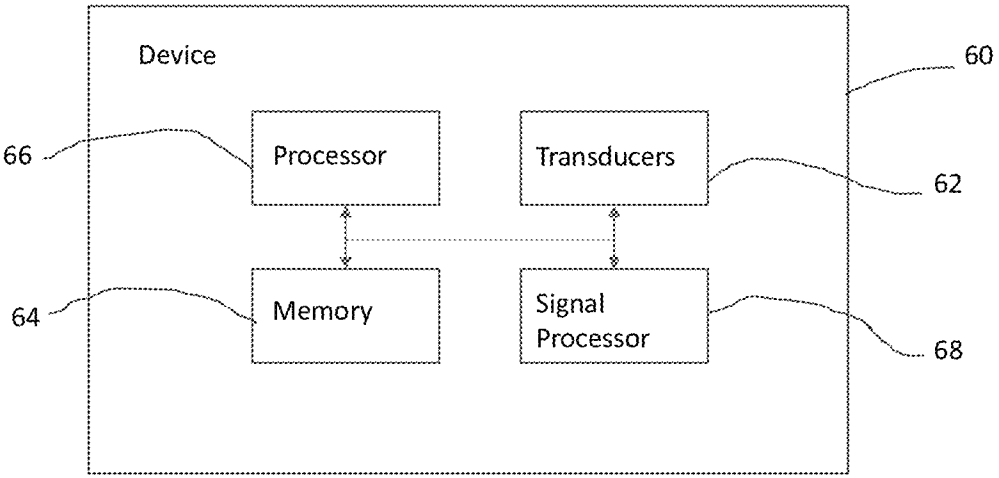
FIG. 5 is a schematic diagram, illustrating the form of an electronic device.

FIG. 5 is a schematic diagram, illustrating the form of such a wearable device 60.

The wearable device 60 may for example take the form of smart glasses, a virtual reality or augmented reality headset, or a wearable camera.

Specifically, FIG. 5 shows various interconnected components of the wearable device 60. It will be appreciated that the wearable device 60 will in practice contain many other components, but the following description is sufficient for an understanding of embodiments of the present disclosure.

Thus, FIG. 5 shows transducers 62, which generate electrical signals in response to their surroundings, as described in more detail below.

FIG. 5 also shows a memory 64, which may in practice be provided as a single component or as multiple components. The memory 64 is provided for storing data and program instructions.

FIG. 5 also shows a processor 66, which again may in practice be provided as a single component or as multiple components.

FIG. 5 also shows signal processing circuitry 68, for performing operations on received signals, including audio signals, as required.

Figure 6:
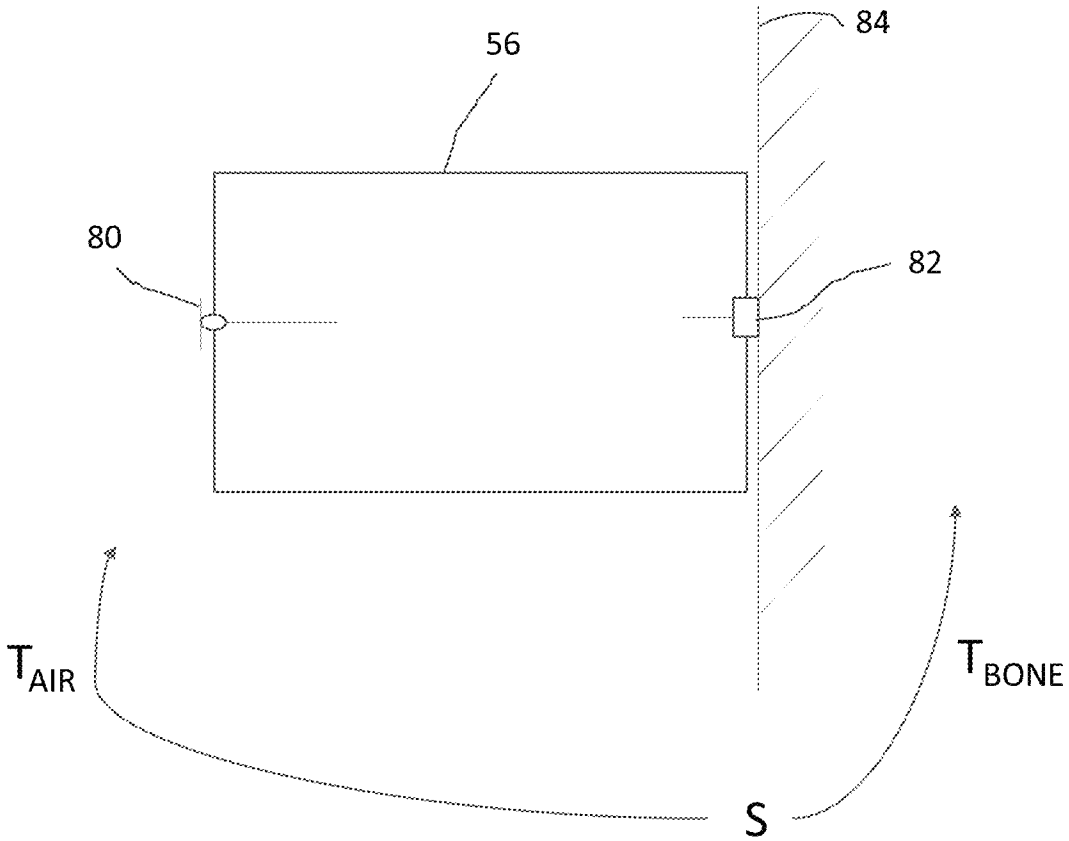
FIG. 6 illustrates in more detail a part of the device of FIG. 4.

FIG. 6 illustrates in more detail a part of the device of FIG. 4.

Specifically, FIG. 6 illustrates an example where the accessory device is a pair of smart glasses, which is being worn. The same situation applies where the accessory device is a headset such as a virtual reality or augmented reality headset.

More specifically, FIG. 6 shows a section of the connecting piece 56 shown in FIG. 4, which passes over the bridge of the wearer's nose.

In general terms, the device comprises a first transducer and a second transducer. While a person is wearing the device, a first transducer is located on an outward facing part of the device and a second transducer is located on a part of the device that is in contact with the wearer's skin, for example on the bridge of their nose.

In the embodiment shown in FIG. 6, the first transducer comprises a microphone 80, located such that it can detect ambient sound in the vicinity of the device.

Further, the second transducer comprises an accelerometer 82, located on the connecting piece 56 such that it is contact with the surface 84 of the wearer's body, for example with the bridge of their nose, and hence such that it can detect vibrations in the surface 84 resulting from the transmission of sound through the wearer's head.

As mentioned above, the accessory device may be any suitable wearable device, which is provided with a microphone for detecting sound that has travelled through the air, and is also provided with a second transducer such as an accelerometer that is mounted in a position that is in contact with the wearer's head when the accessory is being worn, such that the accelerometer can detect vibrations resulting from the transmission of sound through the wearer's head.

In particular, embodiments described herein obtain information about the sound conduction path, through the wearer's head, by comparing the signals detected by the first transducer and the second transducer. More specifically, embodiments described herein obtain information about the sound conduction path, through the wearer's head, by comparing the signals detected by the first transducer and the second transducer at times when the wearer is speaking.

Thus, as shown in FIG. 6, when the wearer is speaking and generating a sound S, this is modified by a first transfer function $T_{AIR}$ through the air before it is detected by the external microphone 80, and it is modified by a second transfer function $T_{BONE}$ through the bone and soft tissue of the wearer's head before it is detected by the second transducer 82.

The processing of the signals generated by the microphone 80, and by the second transducer 82, may be performed in circuitry provided within the connecting piece 56, or elsewhere in the device, as shown in FIG. 5, or may be transmitted by a suitable wired or wireless connection to a host device as shown in FIG. 2, where the processing of the signals, as described in more detail below, takes place.

Figure 7:
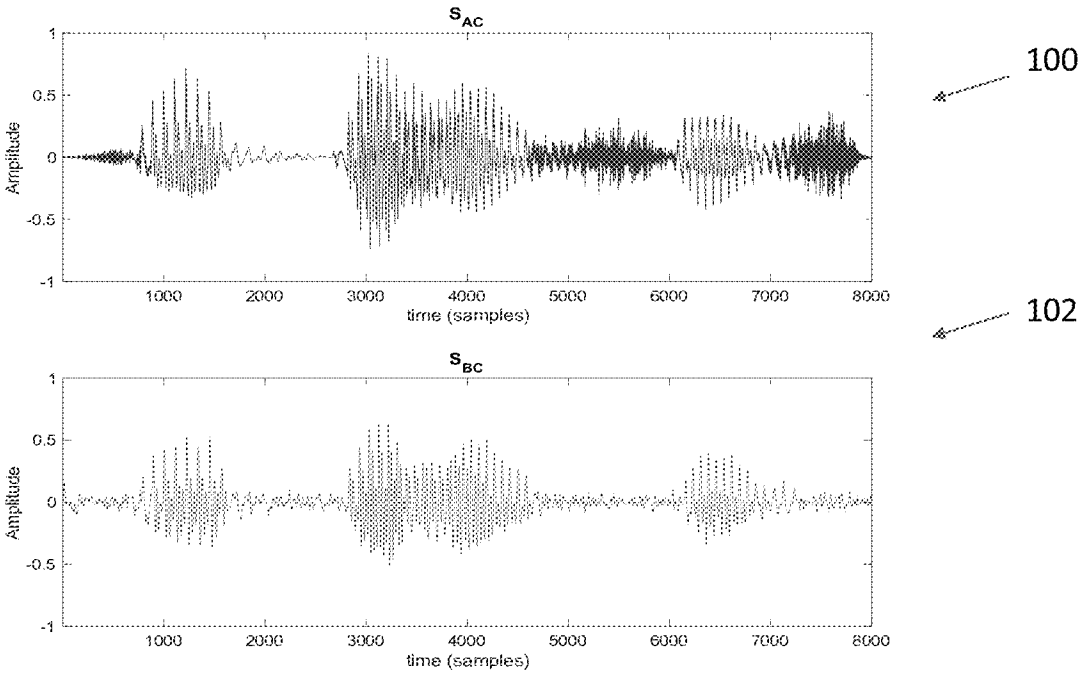
FIG. 7 illustrates signals received by a device of FIG. 1 or FIG. 4.

FIG. 7 illustrates the form of signals that may be generated by the first and second transducers, when a device as described above is being worn. Specifically, FIG. 7 shows the amplitudes of the signals over about 8000 samples of the received signals (representing 1 second of speech).

Specifically, in FIG. 7, the arrow 100 indicates the form of a signal $S_{AC}$ generated by the first transducer (that is, the microphone 34 in a device as shown in FIG. 3 or the microphone 80 in a device as shown in FIG. 6), representing the signal that has been conducted through the air to the transducer. In addition, the arrow 102 indicates the form of a signal $S_{BC}$ generated by the second transducer (that is, the microphone 36 or the accelerometer 38 in a device as shown in FIG. 3 or the accelerometer 82 in a device as shown in FIG. 6), representing the signal that has been conducted through the wearer's body to the transducer.

Both of these signals are generated during a period when the wearer is speaking.

Thus, the first transducer detects the air conducted speech and the second transducer detects the body conducted speech. These two channels are very different. In particular, the body conducted speech is strongly non-linear and band limited, and the air conducted channel is adversely affected by external noise. The effect of this is that the second transducer is able to detect voiced speech, but is not able to detect unvoiced speech to any significant degree.

Thus, it can be seen from FIG. 7 that, during the periods when the signal represents voiced speech, from about 800-1600 samples, from about 3000-4800 samples, and from about 6100-7000 samples, there is a high degree of correlation between the two signals $S_{AC}$ and $S_{BC}$. However, during the periods when the signal represents unvoiced speech, from about 4800-6100 samples, and from about 7000-8000 samples, there is a very low degree of correlation between the two signals $S_{AC}$ and $S_{BC}$, because the second transducer is effectively unable to detect the unvoiced speech.

As mentioned above, FIG. 7 shows typical signals that might be generated when the speaker is wearing the device. Different signals will be generated when the speaker is not wearing the device. When the second transducer is a microphone, for example the microphone 36 in a device as shown in FIG. 3, and the device is not being worn, the microphone 36 will probably be able to detect the sounds just as well as the microphone 34, and so there will be a very high degree of correlation between the signals generated by the two transducers.

Conversely, when the second transducer is an accelerometer, for example the accelerometer 38 in a device as shown in FIG. 3 or the accelerometer 82 in a device as shown in FIG. 6, and the device is not being worn, the accelerometer will probably not be able to detect any signal resulting from voiced speech or from unvoiced speech, and so there will be a very low degree of correlation between the signals generated by the two transducers.

Figure 8:
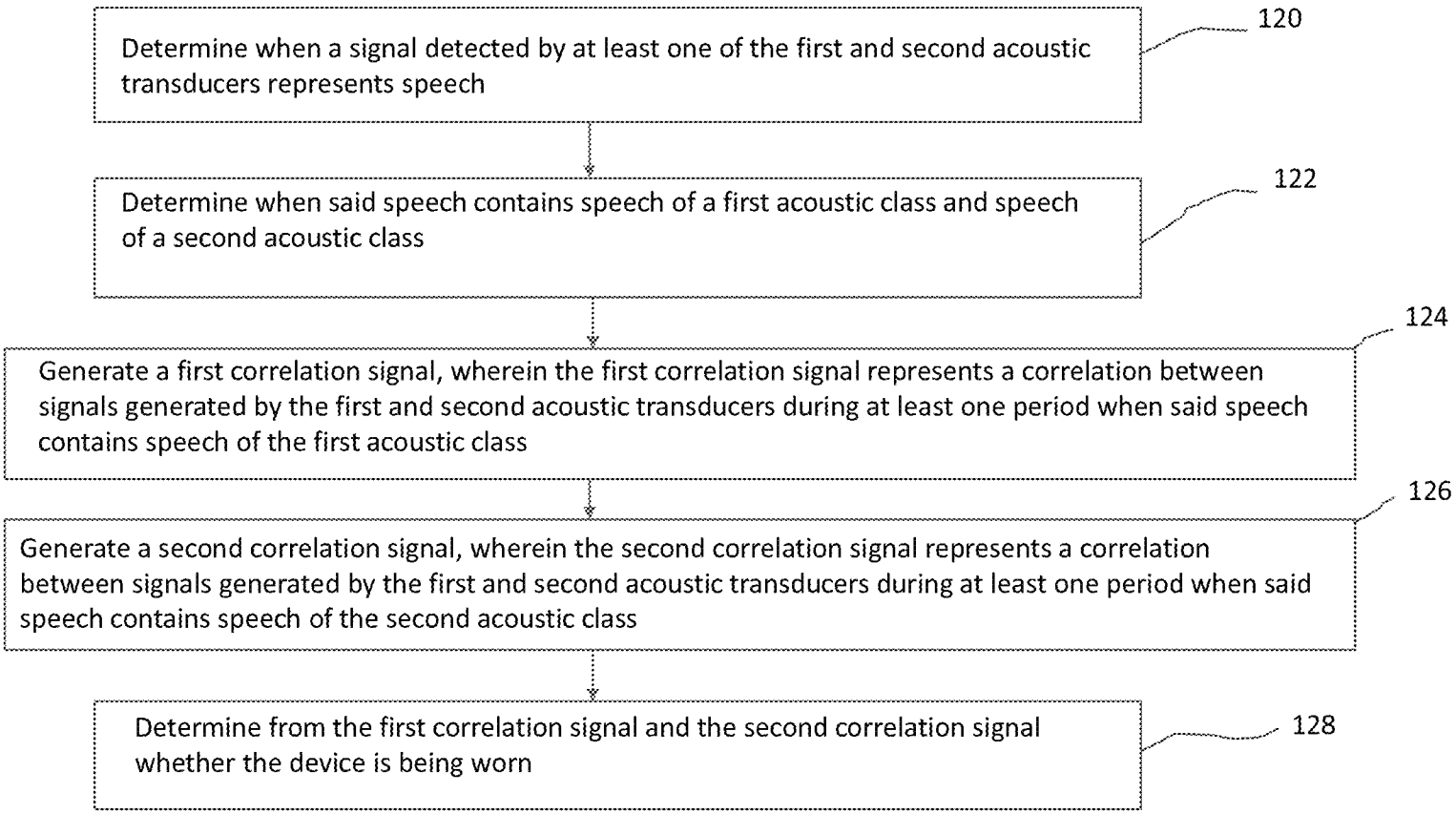
FIG. 8 is a flow chart illustrating a method in accordance with the present disclosure.

FIG. 8 is a flow chart, illustrating a method in accordance with certain embodiments.

Specifically, FIG. 8 shows a method of detecting whether a device is being worn, wherein the device comprises a first transducer and a second transducer.

The first transducer may comprise a microphone.

The second transducer may comprise a microphone. In other embodiments, the second transducer may comprise an accelerometer.

The method comprises step 120, namely determining when a signal detected by at least one of the first and second transducers represents speech.

The method then comprises step 122, namely determining when said speech contains speech of a first acoustic class and speech of a second acoustic class.

In some embodiments, the first acoustic class comprises voiced speech, and the second acoustic class comprises unvoiced speech.

The method then comprises step 124, namely generating a first correlation signal, wherein the first correlation signal represents a correlation between signals generated by the first and second transducers during at least one period when said speech contains speech of the first acoustic class.

Generating the first correlation signal may comprise: calculating energies of the signals generated by the first and second transducers during at least one period when said speech contains speech of the first acoustic class; and calculating a correlation between said signals generated by the first and second transducers during said at least one period when said speech contains speech of the first acoustic class.

The method further comprises step 126, namely generating a second correlation signal, wherein the second correlation signal represents a correlation between signals generated by the first and second transducers during at least one period when said speech contains speech of the second acoustic class.

Similarly to the first correlation signal, generating the second correlation signal may comprise: calculating energies of the signals generated by the first and second transducers during at least one period when said speech contains speech of the second acoustic class; and calculating a correlation between said signals generated by the first and second transducers during said at least one period when said speech contains speech of the second acoustic class.

Finally, the method comprises step 128, namely determining from the first correlation signal and the second correlation signal whether the device is being worn.

In some embodiments, the device is configured such that, when the device is being worn, the first transducer is able to detect ambient sounds transmitted through the air, and the second transducer is able to detect signals transmitted through the head of a wearer. In such embodiments, the method may comprise determining that the device is being worn if the first correlation signal exceeds a first threshold value and the second correlation signal is lower than a second threshold value, and otherwise determining that the device is not being worn.

Figure 9:
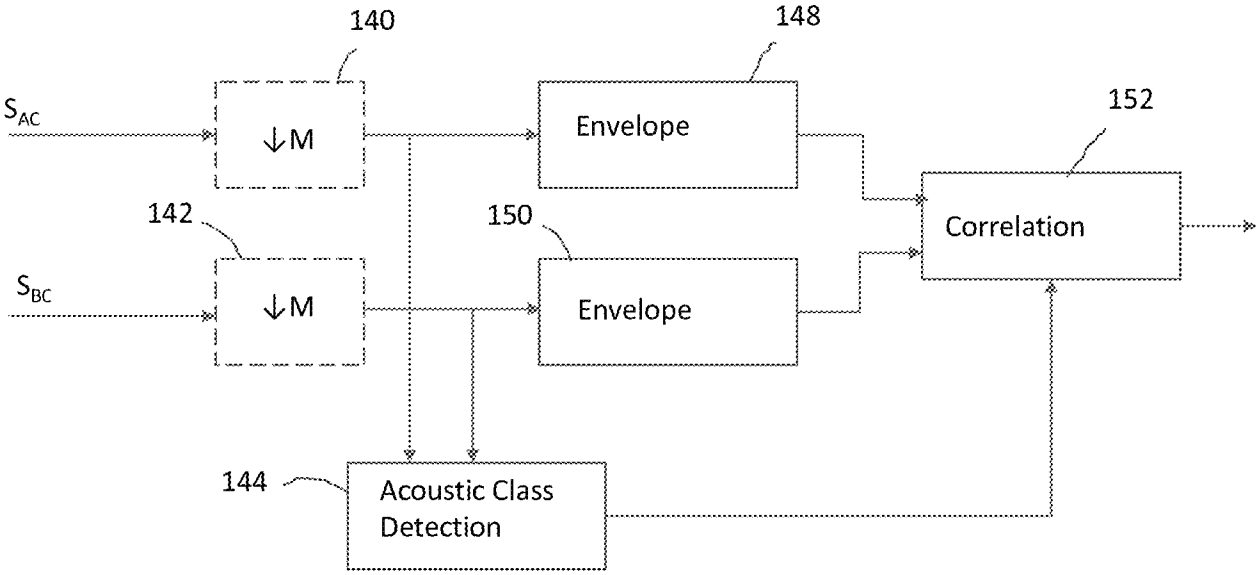
FIG. 9 is a block diagram illustrating a system for performing the method of FIG. 8.

FIG. 9 is a block diagram, illustrating a system for performing the method of FIG. 8.

As shown in FIG. 9, the air-conducted signal $S_{AC}$ received from the first transducer (that is, the microphone 34 in a device as shown in FIG. 3 or the microphone 80 in a device as shown in FIG. 6) is optionally passed to a decimator 140, where it is may be decimated by a factor of M. Similarly, the body-conducted signal $S_{BC}$ received from the second transducer (that is, the microphone 36 or the accelerometer 38 in a device as shown in FIG. 3 or the accelerometer 82 in a device as shown in FIG. 6) is also optionally passed to a second decimator 142, where it is may be decimated by a factor of M.

One or both of the air-conducted signal $S_{AC}$ and the body-conducted signal $S_{BC}$, after any decimation, is then passed to an acoustic class detection block 144, which determines when the signal represents voiced speech, and when the signal represents unvoiced speech. In some embodiments, the signals $S_{AC}$ and $S_{BC}$ have been processed initially, so that the signals passed to the acoustic class detection block 144 always represent speech and the acoustic class detection block 144 indicates segments of the signals that represent voiced speech and unvoiced speech. In other embodiments, the acoustic class detection block 144 differentiates between segments of the signals that represent voiced speech, segments of the signals that represent unvoiced speech, and segments of the signals that do not represent speech.

The energies of the air-conducted signal $S_{AC}$ and the body-conducted signal $S_{BC}$ are then calculated.

In one embodiment, this is done by calculating the envelopes of the received signals. Thus, the air-conducted signal $S_{AC}$, after any decimation, is passed to a first envelope detection block 148 and the body-conducted signal $S_{BC}$, after any decimation, is passed to a second envelope detection block 150.

In other embodiments, calculating the energies of the received signals is performed using Teager-Kaiser operator or Hilbert-transform-based methods.

The outputs of the first envelope detection block 148 and the second envelope detection block 150 are then passed to a correlation block 152, which determines the correlation between the signals. The correlation block 152 also receives the output of the acoustic class detection block 144, so that the correlation block can calculate a first correlation signal value during times when it is determined that the received signals represent voiced speech, and can calculate a second correlation signal value during times when it is determined that the received signals represent unvoiced speech.

The correlation can be performed by a variety of means. For example, for two signals $\alpha$ and $\beta$, the Pearson correlation value $\rho$ is calculated as:

$$\rho = \frac{\mathrm{cov}(\alpha, \beta)}{\sigma_\alpha \cdot \sigma_\beta}$$

where $\mathrm{cov}(\alpha, \beta)$ is the covariance of $\alpha$ and $\beta$,
and $\sigma_\alpha$ and $\sigma_\beta$ are the standard deviations of $\alpha$ and $\beta$, respectively.

The first and second correlation values can then be used to infer whether the device is being worn.

In the case of an earphone 30 as shown in FIG. 3, when the second transducer is the microphone 36, when the device is being worn, there should be a high correlation between the $S_{AC}$ and $S_{BC}$ during voiced speech, and a low correlation during unvoiced speech, but, if the device is out of the user's ear, there should be a very high correlation between the signals at all times. These predictions can be summarised as follows:

| | First correlation value (i.e. during voiced speech) | Second correlation value (i.e. during unvoiced speech) |
|---|---|---|
| Device is being worn | High | Low |
| Device is not being worn | Very high | Very high |

Thus, by setting suitable threshold values, it can be determined whether the first correlation value (i.e. during voiced speech) is above a first threshold value, and it can be determined whether the second correlation value (i.e. during unvoiced speech) is below a second threshold value. If both of these criteria are met, the correlation block 152 can generate an output signal indicating that the device is being worn.

Figure 11:
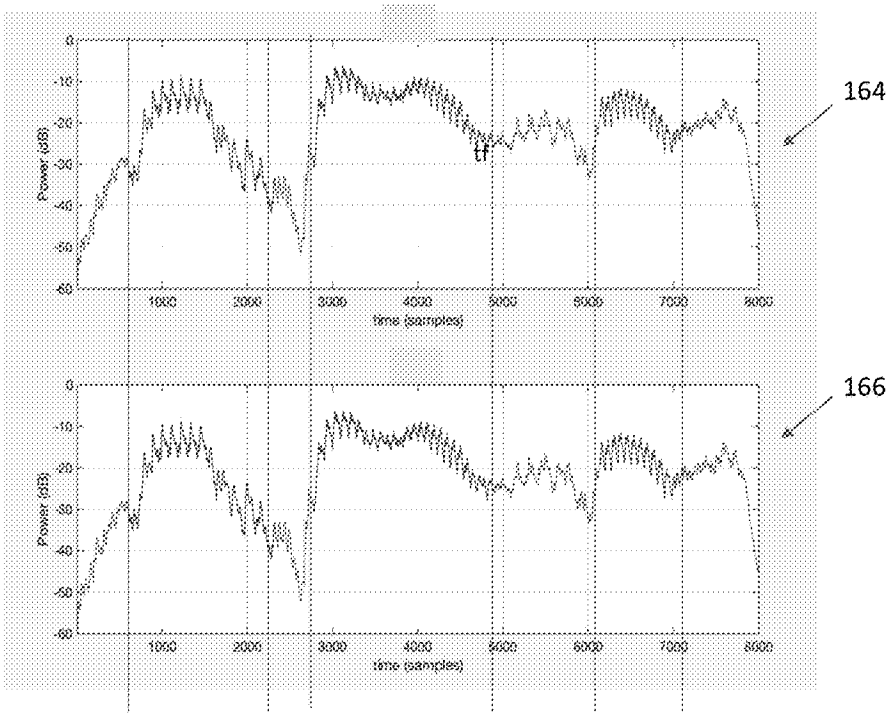
FIGS. 10 and 11 illustrate operation of a part of the system of FIG. 9.
Figure 10:
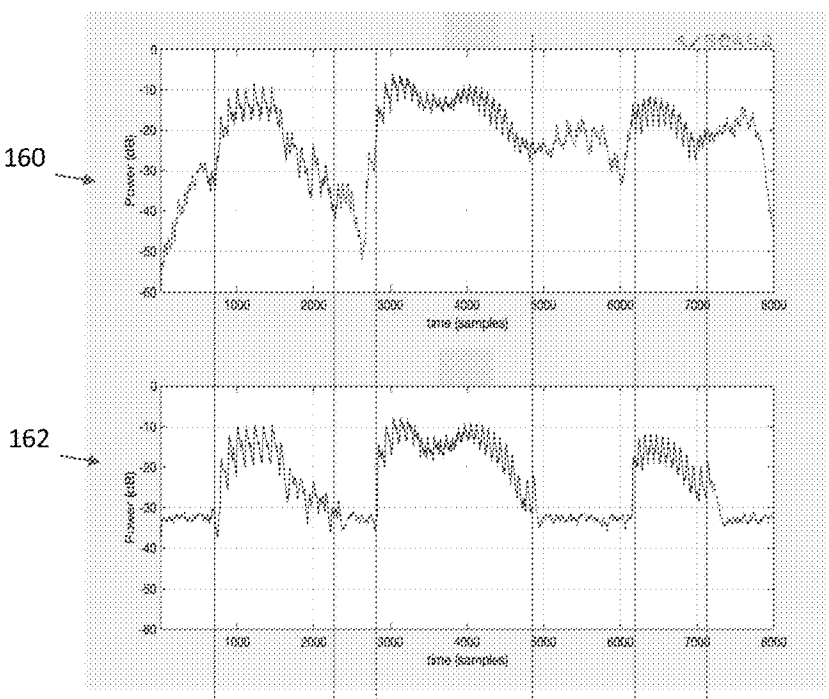

FIG. 10 and FIG. 11 illustrate the results of this method in one example.

FIG. 10 illustrates the situation when the device is being worn, and FIG. 11 illustrates the situation when the device is not being worn. In FIG. 10, the trace 160 shows the signal $S_{AC}$ from the first transducer, and the trace 162 shows the signal $S_{BC}$ from the second transducer. In FIG. 11, the trace 164 shows the signal $S_{AC}$ from the first transducer, and the trace 166 shows the signal $S_{BC}$ from the second transducer.

In both cases, the signal represents voiced speech between the times ta and tb, between the times tc and td, and between the times te and tf. Conversely, the signal represents unvoiced speech before time ta, between the times tb and tc, between the times td and te, and after time tf.

It can be seen that, as predicted, when the device is being worn, as shown in FIG. 10, there is a high correlation (with the Pearson correlation value p calculated to be 0.8) between $S_{AC}$ and $S_{BC}$ during voiced speech, and a low correlation (with the Pearson correlation value p calculated to be 0.07) during unvoiced speech. Conversely, when the device is not being worn, as shown in FIG. 11, there is a very high correlation (with the Pearson correlation value p calculated to be 1.0) between $S_{AC}$ and $S_{BC}$ during voiced speech, and similarly a very high correlation (with the Pearson correlation value p again calculated to be 1.0) during unvoiced speech.

In the case of an earphone 30 as shown in FIG. 3, when the second transducer is the accelerometer 38, or in the case of the glasses or headset 52 as shown in FIG. 4, the situation is slightly different. In this case, again, when the device is being worn, the air-conducted signal will pass straight to the first transducer, i.e. the microphone 34 as shown in FIG. 3, or the microphone 80 shown in FIG. 6. Also, as before, due to the acoustics of speech production, only voiced speech will be strongly transmitted to the second transducer. Thus, again, there should be a high correlation between $S_{AC}$ and $S_{BC}$ during voiced speech, and a low correlation during unvoiced speech.

However in this case, if the device is not being worn, in general $S_{AC}$ and $S_{BC}$ will correlate poorly, since the first transducer will still be able to detect speech, but the second transducer will not. There is however a special case, where by chance the device is placed on an audio transducer (e.g. a loudspeaker), which is playing recorded speech. In this situation, the second transducer will detect the effects of the speech, but it will detect the effects of voiced and unvoiced speech to the same extent, and so $S_{AC}$ and $S_{BC}$ will correlate both during voiced speech and during unvoiced speech.

| | First correlation value (i.e. during voiced speech) | Second correlation value (i.e. during unvoiced speech) |
|---|---|---|
| Device is being worn | High | Low |
| Device is not being worn | Low | Low |
| Device is not being worn, and is located on an audio transducer | High | High |

Thus, again, by setting suitable threshold values, it can be determined whether the first correlation value (i.e. during voiced speech) is above a first threshold value, and it can be determined whether the second correlation value (i.e. during unvoiced speech) is below a second threshold value. If both of these criteria are met, the correlation block 152 can generate an output signal indicating that the device is being worn.

The correlation between the signals generated by two transducers in a wearable deice can also be used for other purposes.

For example, respiratory disease is one of the most prevalent chronic health conditions, and yet monitoring coughs outside of clinical conditions is very essentially unknown.

The document "Robust Detection of Audio-Cough Events Using Local Hu Moments", Jesus Monge-Alvarez, Carlos Hoyos-Barcelo, Paul Lesso, Pablo Casaseca-de-la-Higuera, IEEE J Biomed Health Informatics, 2019 January; 23(1): 184-196 discloses monitoring coughs using audio signals in clinical conditions.

However, this flags all coughs detected, and is unable to distinguish the coughs of the intended observed subject from the coughs of other people.

Figure 12:
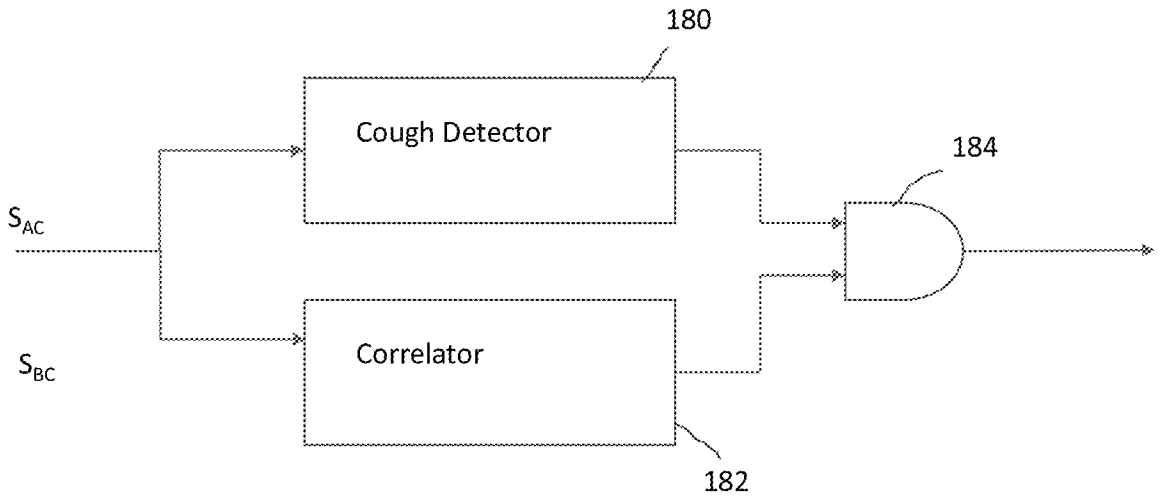
FIG. 12 is a block diagram illustrating a system for performing a method.

FIG. 12 shows a system that can be used to monitor the coughs of a person wearing a wearable device, and distinguish the coughs of that person from the coughs of other people.

The wearable device may for example be an earphone or a par of glasses, as shown in, and as described with reference to, any of FIGS. 1 to 6.

In this illustrated embodiment, the signal from one of the transducers, that is, either the first transducer or the second transducer, is passed to a cough detector 180, operating for example in accordance with the method disclosed in the paper by Monge-Alvarez mentioned above. Specifically, in this illustrated embodiment, it is the air-conducted signal $S_{AC}$ from the first transducer that is passed to the cough detector 180.

The signals from the two transducers, that is the air-conducted signal $S_{AC}$ from the first transducer and the body-conducted signal $S_{BC}$ from the second transducer, are passed to a correlator 182, which can operate in the same manner as the correlation block 152 shown in FIG. 9, by comparing the energies of the two signals.

It would be expected that there would be a good correlation between the air-conducted signal $S_{AC}$ and the body-conducted signal $S_{BC}$ if the wearer of the device coughs, but it would be expected that there would be very low correlation between the air-conducted signal $S_{AC}$ and the body-conducted signal $S_{BC}$ if another nearby person coughs.

The outputs of the cough detector 180 and the correlator 182 are passed to a combiner 184. The combiner 184 can generate a flag to indicate that the person wearing the device has coughed, only if the cough detector 180 detects a cough, and the correlator 182 indicates that there is a high degree of correlation between the air-conducted signal $S_{AC}$ and the body-conducted signal $S_{BC}$.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single feature or other unit may fulfil the functions of several units recited in the claims. Any reference numerals or labels in the claims shall not be construed so as to limit their scope.

The skilled person will recognise that some aspects of the above-described apparatus and methods may be embodied as processor control code, for example on a non-volatile carrier medium such as a disk, CD- or DVD-ROM, programmed memory such as read only memory (Firmware), or on a data carrier such as an optical or electrical signal carrier. For many applications embodiments of the invention will be implemented on a DSP (Digital Signal Processor), ASIC (Application Specific Integrated Circuit) or FPGA (Field Programmable Gate Array). Thus the code may comprise conventional program code or microcode or, for example code for setting up or controlling an ASIC or FPGA. The code may also comprise code for dynamically configuring re-configurable apparatus such as re-programmable logic gate arrays. Similarly the code may comprise code for a hardware description language such as Verilog TM or VHDL (Very high speed integrated circuit Hardware Description Language). As the skilled person will appreciate, the code may be distributed between a plurality of coupled components in communication with one another. Where appropriate, the embodiments may also be implemented using code running on a field-(re)programmable analogue array or similar device in order to configure analogue hardware.

Note that as used herein the term module shall be used to refer to a functional unit or block which may be implemented at least partly by dedicated hardware components such as custom defined circuitry and/or at least partly be implemented by one or more software processors or appropriate code running on a suitable general purpose processor or the like. A module may itself comprise other modules or functional units. A module may be provided by multiple components or sub-modules which need not be co-located and could be provided on different integrated circuits and/or running on different processors.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative. Accordingly, modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described above.

Unless otherwise specifically noted, articles depicted in the drawings are not necessarily drawn to scale.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

Although specific advantages have been enumerated above, various embodiments may include some, none, or all of the enumerated advantages. Additionally, other technical advantages may become readily apparent to one of ordinary skill in the art after review of the foregoing figures and description.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

The invention claimed is:

1. A method of detecting whether a device is being worn, wherein the device comprises a first transducer and a second transducer, the method comprising:

determining when a signal detected by at least one of the first and second transducers represents speech;

determining when said speech contains speech of a first acoustic class and speech of a second acoustic class;

generating a first correlation signal, wherein the first correlation signal represents a correlation between signals generated by the first and second transducers during at least one period when said speech contains speech of the first acoustic class;

generating a second correlation signal, wherein the second correlation signal represents a correlation between signals generated by the first and second transducers during at least one period when said speech contains speech of the second acoustic class; and determining from the first correlation signal and the second correlation signal whether the device is being worn.

2. A method according to claim 1, wherein generating the first correlation signal comprises:

calculating energies of the signals generated by the first and second transducers during at least one period when said speech contains speech of the first acoustic class; and calculating a correlation between said signals generated by the first and second transducers during said at least one period when said speech contains speech of the first acoustic class.

3. A method according to claim 1, wherein generating the second correlation signal comprises:

calculating energies of the signals generated by the first and second transducers during at least one period when said speech contains speech of the second acoustic class; and calculating a correlation between said signals generated by the first and second transducers during said at least one period when said speech contains speech of the second acoustic class.

4. A method according to claim 1, wherein the first acoustic class comprises voiced speech, and the second acoustic class comprises unvoiced speech.

5. A method according to claim 4, wherein the device is configured such that, when the device is being worn, the first transducer is able to detect ambient sounds transmitted through the air, and the second transducer is able to detect signals transmitted through the head of a wearer, and wherein the method comprises:

determining that the device is being worn if the first correlation signal exceeds a first threshold value and the second correlation signal is lower than a second threshold value, and otherwise determining that the device is not being worn.

6. A method according to claim 1, wherein the first transducer comprises a microphone.

7. A method according to claim 1, wherein the second transducer comprises a microphone.

8. A method according to claim 1, wherein the second transducer comprises an accelerometer.

9. A device comprising:

a processor configured for receiving signals from a first transducer and a second transducer, and further configured for performing a method comprising:

determining when a signal detected by at least one of the first and second transducers represents speech;

determining when said speech contains speech of a first acoustic class and speech of a second acoustic class;

generating a first correlation signal, wherein the first correlation signal represents a correlation between signals generated by the first and second transducers during at least one period when said speech contains speech of the first acoustic class;

generating a second correlation signal, wherein the second correlation signal represents a correlation between signals generated by the first and second transducers during at least one period when said speech contains speech of the second acoustic class; and determining from the first correlation signal and the second correlation signal whether the device is being worn.

10. A device according to claim 9, further comprising said first and second transducers, wherein the first transducer is positioned such that it can detect a sound of a wearer's speech, and wherein the second transducer is positioned such that, when the device is being worn, the second transducer can generate a signal in response to transmission of the wearer's speech through the wearer's body.

11. A device according to claim 9, wherein the first transducer comprises a microphone.

12. A device according to claim 9, wherein the second transducer comprises an accelerometer.

13. A device according to claim 9, wherein the second transducer comprises a microphone.

14. A device according to claim 9, wherein the device comprises a headset, and wherein the second transducer is positioned such that, when the device is being worn, the second transducer is located in an ear canal of the wearer.

15. A device according to claim 14, configured for determining that the device is being worn if the first correlation signal exceeds a first threshold value and the second correlation signal is lower than a second threshold value, and otherwise determining that the device is not being worn.

16. A device according to claim 9, wherein the second transducer is positioned such that, when the device is being worn, the second transducer is located on a bridge of the nose of the wearer.

17. A device according to claim 16, configured for determining that the device is being worn if the first correlation signal exceeds a first threshold value and the second correlation signal is lower than a second threshold value, and otherwise determining that the device is not being worn.

18. A device according to claim 16, wherein the device comprises smart glasses, a virtual reality headset, or an augmented reality headset.

19. A device according to claim 9, further comprising an input for receiving said signals from the first and second transducers from a separate device.

20. A computer program product, comprising a computer readable device, comprising instructions stored thereon for performing a method of detecting whether a device is being worn, wherein the device comprises a first transducer and a second transducer, the method comprising:

determining when a signal detected by at least one of the first and second transducers represents speech;

determining when said speech contains speech of a first acoustic class and speech of a second acoustic class;

generating a first correlation signal, wherein the first correlation signal represents a correlation between signals generated by the first and second transducers during at least one period when said speech contains speech of the first acoustic class;

generating a second correlation signal, wherein the second correlation signal represents a correlation between signals generated by the first and second transducers during at least one period when said speech contains speech of the second acoustic class; and determining from the first correlation signal and the second correlation signal whether the device is being worn.

* * * * *